US005535599A

United States Patent [19]

Smith et al.

[11] Patent Number: 5,535,599

[45] Date of Patent: Jul. 16, 1996

[54] MODULAR TABLE ROLL WITH WATER BATH

[75] Inventors: Olan R. Smith; Michael J. Suchan, both of Regina, Canada

[73] Assignee: IPSCO Enterprises Inc., Wilmington, Del.

[21] Appl. No.: 301,919

[22] Filed: Sep. 7, 1994

[51] Int. Cl.[6] ..... F25B 17/02

[52] U.S. Cl. ..... 62/374; 62/64; 72/201

[58] Field of Search ..... 62/63, 64, 374, 62/375, 381; 72/201

[56] References Cited

U.S. PATENT DOCUMENTS

| | | | |
|---|---|---|---|
| 1,820,074 | 8/1931 | Kilborn . | |
| 3,136,182 | 6/1964 | Wegmann et al. | 80/1 |
| 3,646,790 | 3/1972 | Properzi | 72/43 |
| 3,668,911 | 6/1972 | Properzi | 72/43 |
| 3,712,102 | 6/1973 | Eibe | 72/238 |
| 3,990,257 | 11/1976 | Taylor et al. | 62/63 |
| 4,251,180 | 2/1981 | Hansen | 414/560 |
| 4,444,035 | 4/1984 | Akita et al. | 72/100 |
| 4,578,957 | 4/1986 | Cunningham | 62/63 |
| 4,974,437 | 12/1990 | Schiller | 72/236 |

*Primary Examiner*—Ronald C. Capossela
*Attorney, Agent, or Firm*—Robert H. Barrigar; Barrigar & Moss

[57] ABSTRACT

Modular roll apparatus particularly suitable for conveying hot material such as a sheet of steel being processed. Each roll has its own individual water bath and drive mechanism. A water trough isolates the bath from the bearings and drive mechanism for the roll and bathes the underside of the roll to cool it. The entire modular unit can be removed from its operating position and replaced by a similar such unit. A conveyor containing a multiplicity of such units is suitable for conveying hot sheet steel or other hot material in a processing mill.

20 Claims, 3 Drawing Sheets

MODULAR TABLE ROLL WITH WATER BATH

FIELD OF THE INVENTION

This invention relates to a modular bathed driving roll apparatus and a conveyor incorporating same, especially for conveying hot material. The invention is useful for supporting and driving a slab or sheet of steel in a steel rolling mill. More specifically, the modular table roll apparatus comprises a roll, drive mechanism and trough for a water bath for the roll, in the form of a single, removable modular unit.

BACKGROUND OF THE INVENTION

In a steel rolling mill, sheets (slabs, strips, etc.) of steel in various stages of the fabrication process are supported and moved about by rolls. Such rolls are power-driven and mounted parallel to each other, forming a support and conveyor for the steel sheets. The rolls may be air cooled or water sprayed. A plurality of rolls may be connected to one another via a suitable drive mechanism. Repairing or replacing the components of this conventional system is a cumbersome task. If a roll has to be replaced, the drive mechanism must be laboriously disassembled, rendering inoperative all the interconnected rolls driven by the drive assembly until the repair is completed. Cooling of the rolls may be haphazard and uneven.

SUMMARY OF THE INVENTION

Our invention is a modular roll apparatus, each individual roll having its own water bath and drive mechanism, positioned and operating together as a modular unit. A plurality of such units form a conveyor. In use, a conveyor comprising a plurality of such modular units can support and move a sheet of steel (say). Each modular table roll unit can be removed as a complete self-contained unit from the line of rolls and replaced quickly by a replacement modular unit of identical structure. Thus, if a unit or a component thereof requires replacement, it is a simple and quick operation to remove the unit and insert a new one. Repairs on the removed unit are facilitated by being able to move the unit to a suitable working area.

Further, each such unit has a trough to contain its own self-contained water bath. This enables the conveyor as a whole to continue to function if one of the troughs develops a leak or its water supply fails. Further in contrast to conventional design, a whole bath serving a number of rolls need not be drained merely to replace one roll.

DETAILED DESCRIPTION OF THE PREFERRED EMBODIMENT

Figure 1:
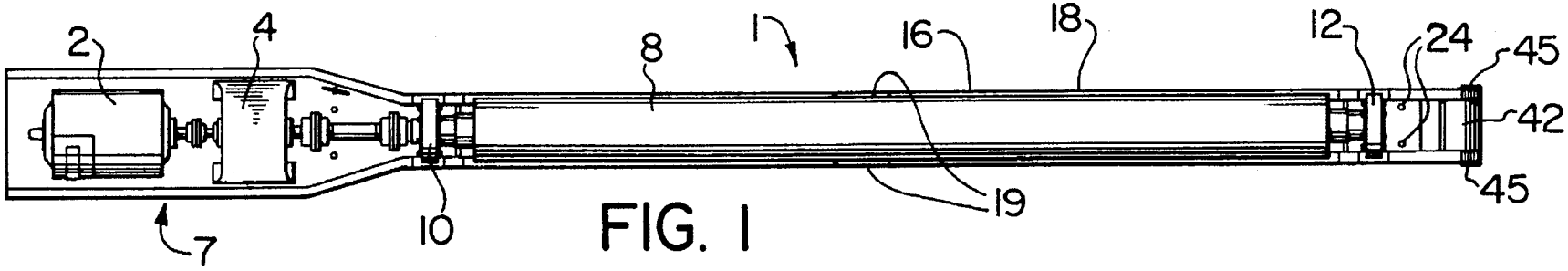
FIG. 1 is a plan view of a modular table roll according to our invention.
Figure 2:
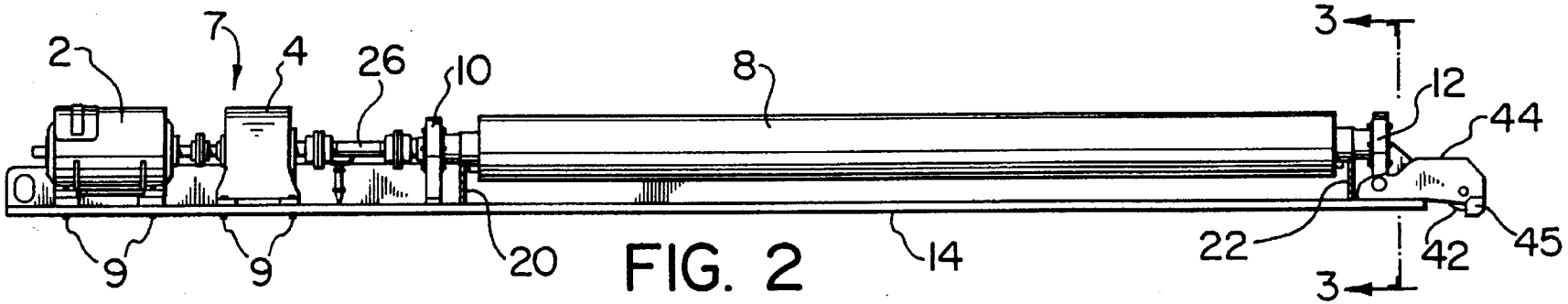
FIG. 2 is a side elevation view of the roll of FIG. 1, absent the lateral sides of the trough.
Figure 3:
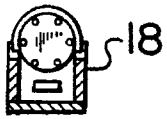
FIG. 3 is a section view of the apparatus of FIG. 1 on the line 3—3 of FIG. 2, including the lateral sides of the trough.

Referring to FIGS. 1 to 3, modular table roll apparatus 1 has a drive mechanism generally indicated as 7 comprising an electric motor 2, transmission 4 and drive shaft 26. The shaft 26 is coupled to and drives table roll 8, which is supported in bearing assemblies 10 and 12. The drive motor 2, transmission 4, drive shaft 26 and roll 8 are linked by conventional coupling assemblies. The drive motor 2, transmission 4 and bearing assemblies 10 and 12 are affixed to an elongated base plate 14 by means of bolt-and-nut assemblies 9. The base plate 14 has bolt holes 24 whereby it can be affixed to a support or receptacle within the rolling table of the mill.

A watertight trough 16 surrounds a lower segment of roll 8. The trough 16 has side walls 18, and end walls 20 and 22 located inwardly of bearing assemblies 10 and 12 respectively. The base 14 forms the bottom of the trough 16. The end walls 20, 22 isolate water within trough 16 from the bearings 10, 12 and from the drive mechanism 7. In use, trough 16 is filled with water so that most of the lower part of roll 8 is wetted with water and is cooled by the water as the roll is rotated in bearing assemblies 10 and 12 by drive motor 2. While a water-level regulator for the trough 16 could be devised, it is simpler to run water continuously into the trough 16 and to permit it to overflow via slots 19 in the upper side walls of the trough 16, which slots 19 are preferably conveniently located above a drainage sluiceway (not shown) underneath the table rolls. A hand valve (not shown) can be used to regulate the water flow into the trough 16. Normally the rolls 8 constantly rotate throughout a given cycle of mill operation, whether or not they are for the time being transporting steel strip or plate, so as to maintain constant cooling of the rolls 8 and mechanical and thermal equilibrium throughout the conveyor.

Figure 6:
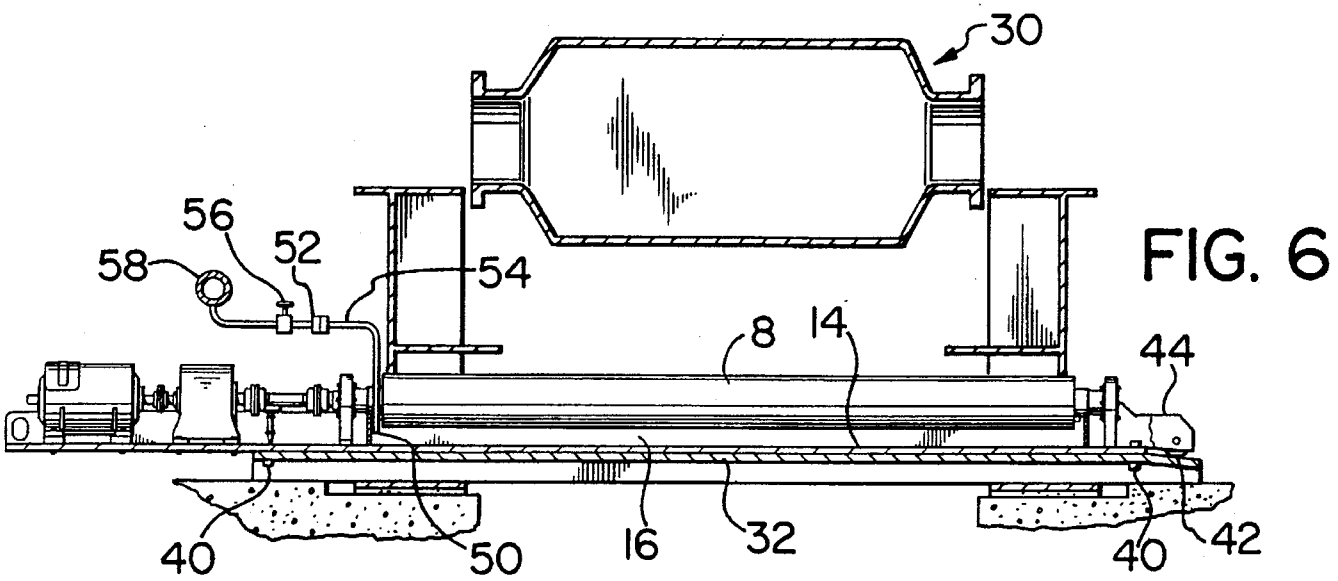
FIG. 6 is a front elevation view partially in section along the line 6—6 of FIG. 4 illustrating a representative positioning of a modular table roll assembly in position beneath a coiler furnace shown schematically in section in FIG. 6.

A suitable water supply for the trough 16 is illustrated in FIG. 6. Water enters the trough 16 via the open end 50 of a water supply pipe 54. The end 50 of the supply pipe 54 should be positioned below the surface level of water within the trough 16 so as to avoid unnecessary splashing and turbulence. A valve 56 controls the flow of water through supply pipe 54. A quick-disconnect coupling 52 is conveniently interposed between the area supply conduit 58 and supply pipe 54 to permit rapid connection and disconnection of the supply pipe 54 from the area supply conduit for purposes of convenient insertion and removal of the modular unit 1 from time to time as required.

Figure 4:
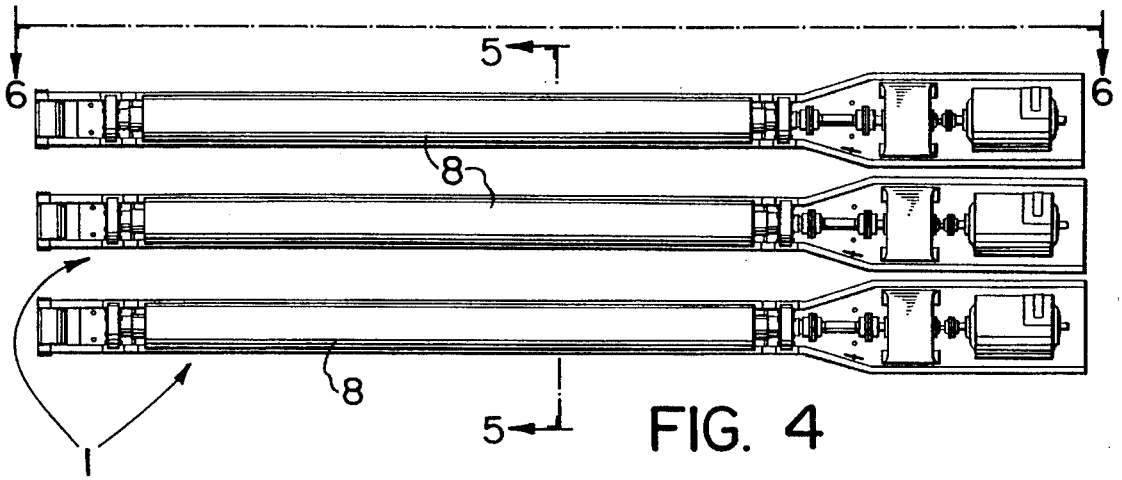
FIG. 4 is a plan view of an array of three modular table roll assemblies, each conforming to the assembly illustrated in FIG. 1, the array of FIG. 4 forming a portion of a table roll conveyor.

A representative use of a table roll module of the type illustrated in FIGS. 1, 2 and 3 is as part of a table roll conveyor in a steel mill. FIGS. 4 to 7 illustrate a representative such use. In FIG. 4, three such units 1 are shown in plan view in a generally horizontal array for the purposes of transporting steel strip or plate in a direction generally perpendicular to the axes of rotation of table rolls 8 of the modular units 1 of FIG. 4. Each modular unit 1 of FIG. 4 is essentially identical to the modular unit 1 illustrated in FIG.

1, although, of course, modifications and variants will readily occur to those skilled in the technology.

The series of table rolls illustrated in FIG. 4, of course, would be a small fraction of the total number of table rolls required in a rolling mill, all of which could, if desired, conform to the modular unit arrangement illustrated in FIGS. 1 to 3.

Figure 5:
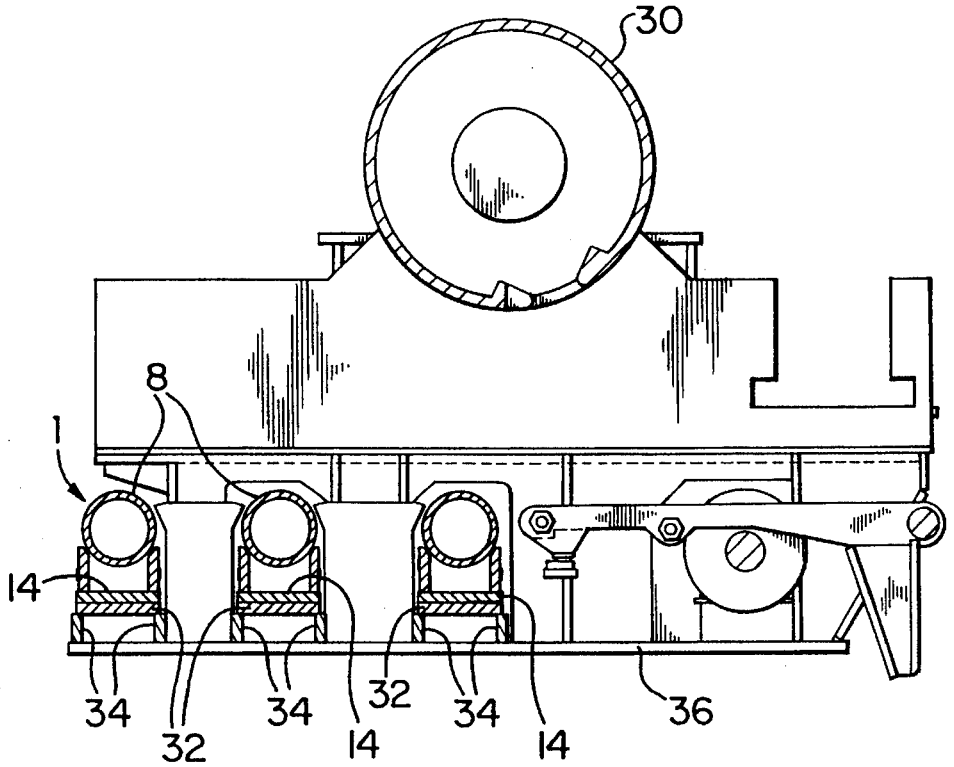
FIG. 5 is an end elevation view partially in section along the line 5—5 of FIG. 4 illustrating an exemplary positioning of the table roll modular array of FIG. 4 in position beneath a coiler furnace shown schematically in FIG. 5.
Figure 7:
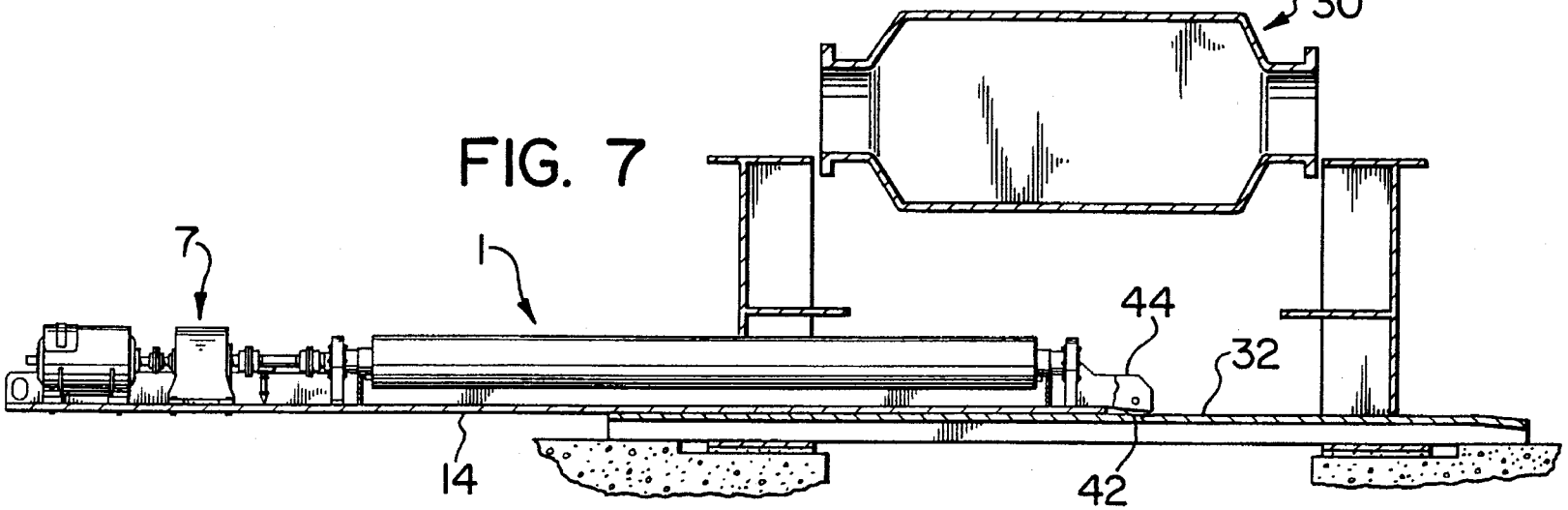
FIG. 7 shows the coiler furnace and table roll modular assembly of FIG. 6 with the modular table roll assembly illustrated as being partially removed from its normal operating position beneath the coiler furnace.

The configuration of FIG. 4 might, for example, appear underneath a coiler furnace 30, which is schematically depicted in FIGS. 5, 6 and 7. Note that the table roll 8 is normally longer in extension than the width of steel strip that it conveys. That width will, of course, be narrower than the limiting dimension L of coiler furnace 30. This selection of dimensions offsets the drive unit 7 and bearings 10, 12 away from direct radiant heat from the coiler furnace 30.

It can be seen from FIGS. 5, 6 and 7 that each base plate 14 rests on a frame support plate or track 32, in turn supported by, and affixed to, track beams 34. Each track beam 34 may be welded to or otherwise fixed to a generally horizontally extending support frame beam 36 at the point of surface engagement of these elements indicated as point of engagement 38 for the left-most modular unit 1 illustrated in FIG. 5.

Each of the base plates 14 of the modular assemblies 1 is bolted to its underlying support plate 32 by means of nuts and bolts 40 passing through bolt holes 24 in the base plates 14 and corresponding bolt holes (not specifically illustrated) in the support plates 32.

If any of the modular assemblies 1 is defective and requires repair or replacement for any reason, or is to be removed for routine maintenance, it is a simple job to remove the hold-down bolts 40 and pull the entire modular unit 1 transversely to the left, as seen in FIGS. 6 and 7. FIG. 7 shows one such assembly partly removed from its normal operating position (FIG. 6). A suitable quick disconnect arrangement (not shown) between the electric motor 2 and its power supply will facilitate ready removal and reinstallation. Removal is also facilitated by providing at the extremity of the modular unit 1, remote from the drive mechanism 7, a support wheel or roller 42 rotatably mounted in a mounting bracket 44 fixed to the end of face plate 14 remote from drive mechanism 7. Conveniently, the roller 42 is at least as wide as track 32, and housing 44 is provided with depending guide tabs 45 (FIGS. 1 and 2) so that the track 32 is embraced by the guide tabs 45. This facilitates proper alignment of the modular unit 1 on the supporting track 32 when the modular unit is inserted for installation. For convenience of illustration, guide tabs 45 are not shown in FIGS. 6 and 7.

Various modifications of the design will readily occur to a person skilled in the art. Such modifications are within the scope of our invention, which is defined in the following claims.

What is claimed is:

1. Modular table roll apparatus for incorporation into a roll table for supporting and driving a sheet or strip of steel comprising:

a) a single roll having an uninterrupted cylindrical surface and a longitudinal axis;

b) drive means coupled to one end of the roll for drivingly rotating the roll about its longitudinal axis;

c) a trough underlying the roll for containing cooling water, said trough being positioned such that the underside of the roll is bathed by water within the trough when the trough is filled with water to a predetermined level; and d) said roll, drive means and trough being attached together as a removable, modular unit.

2. Modular table roll apparatus according to claim 1, wherein the trough comprises side walls and a base, the base extending longitudinally beyond the trough, and the drive means being mounted on the base.

3. Modular table roll apparatus as defined in claim 2 for removable installation in a support frame having a transverse track located beneath the roll, additionally comprising at the end thereof remote from the drive means a support wheel mounted for rotation about a horizontal axis transverse to the axis of rotation of the driving roll for rollable support of the modular apparatus along said track when the end thereof which the drive mechanism is fixed is lifted and the apparatus removed from the support frame.

4. Modular table roll apparatus as defined in claim 2, additionally comprising water supply means for supplying a controllable flow of water to the trough.

5. Modular table roll apparatus according to claim 1, wherein the drive means comprises a drive motor and a transmission.

6. Modular table roll apparatus according to claim 1, further comprising a base, and wherein the trough, roll and drive means are mounted on the base.

7. Table roll apparatus for supporting and driving a sheet or strip of heated material, comprising a plurality of aligned modular units, each said unit comprising:

(i) a roll having an uninterrupted cylindrical surface and a longitudinal axis;

(ii) a roll drive coupled to one end of said roll for rotating said roll about said axis;

(iii) a container for liquid coolant mounted beneath said roll so that coolant liquid within said container is in contact with the roll to bathe the underside of the roll with coolant during rotation of the roll when the container is filled with coolant to a predetermined level; and (iv) support structure for attaching said roll, said roll drive and said container together as a removable modular unit.

8. Apparatus according to claim 7 when the container is a trough having side walls and a base, said base extending longitudinally outward of the trough and the roll drive being mounted on the base.

9. Apparatus in accordance with claim 8 for removable installation in a support frame having a transverse track located beneath the roll, and which includes a support wheel mounted at the end of the support structure remote from the roll drive for rotation about a horizontal axis transverse to the axis of rotation of said roll for rollable support of the modular apparatus along said track when the end of the apparatus fixed to the roll drive is lifted and the apparatus removed from the support frame.

10. Apparatus in accordance with claim 8 which also includes a coolant liquid supply for supplying a controllable flow of coolant to the trough.

11. Apparatus in accordance with claim 7 in which the roll drive includes a drive motor and a transmission.

12. Apparatus in accordance with claim 7 which also includes a base, and the container, roll and roll drive are mounted on the base.

13. Apparatus in accordance with claim 7 in which the conveyor device includes a plurality of rolls each having its own roll drive and coolant container.

14. Apparatus in accordance with claim 7 in which the coolant is water.

15. Apparatus in accordance with claim 7 in which the heated material is metal.

16. Apparatus in accordance with claim 7 in which the heated material is steel.

17. Modular table roll apparatus for removable installation in a support frame having a transverse track located beneath the roll, and for supporting and driving a sheet or strip of steel, comprising:

(i) a single roll having a longitudinal axis;

(ii) drive means coupled to the roll for drivingly rotating the roll about its longitudinal axis;

(iii) a trough underlying the roll for containing cooling water, said trough comprising side walls and a base, the base extending longitudinally beyond the trough, and the drive means being mounted on the base, the trough being positioned such that the underside of the roll is bathed by water within the trough when the trough is filled with water to a predetermined level, said roll, drive means and trough being attached together as a removable, modular unit; and (iv) a support wheel mounted for rotation on the roll remote from the drive means about a horizontal axis transverse to the axis of rotation of the roll for rollable support of the modular apparatus along said track when the end thereof to which the drive means is fixed is lifted and the apparatus is removed from the support frame.

18. Modular table roll apparatus for removable installation in a support frame having a transverse track located beneath the roll, and for supporting and driving a sheet or strip of heated material, comprising:

(i) a conveyor device for conveying the material including at least one roll having a longitudinal axis;

(ii) a roll drive coupled to said roll for rotating said roll about said axis;

(iii) a trough for liquid coolant mounted beneath said roll, said trough comprising said walls and a base, the base extending longitudinally outward of the trough, and the roll drive being mounted on the base, the trough being positioned so that coolant liquid within said trough is in contact with the roll to bathe the underside of the roll with coolant during rotation of the roll when the trough is filled with coolant;

(iv) a support structure for attaching said roll, said roll drive and said trough together as a removable modular unit; and (v) a support wheel mounted for rotation on the support structure remote from the roll drive about a horizontal axis transverse to the axis of rotation of the said roll for rollable support of the modular apparatus along said track when the end thereof to which the drive mechanism is fixed is lifted and the apparatus is removed from the support frame.

19. Modular table roll apparatus for use in a hot rolling mill for supporting and driving a hot sheet or strip of steel, comprising: p1 a) a single roll having an uninterrupted cylindrical surface and a longitudinal axis;

b) drive means coupled to one end of the roll for drivingly rotating the roll about its longitudinal axis;

c) a trough underlying the roll for containing cooling water, said trough being positioned such that the underside of the roll is bathed by water within the trough when the trough is filled with water to a predetermined level, and d) said roll, drive means and trough being attached together as a removable, modular unit.

20. Modular table roll apparatus for supporting and driving a hot sheet or strip of metal comprising:

a) a roll having a longitudinal axis and a cylindrical support surface along a central portion of the roll that is devoid of protruding structure;

b) a drive device coupled to the roll for drivingly rotating the roll about its longitudinal axis;

c) a trough underlying the roll for containing cooling water, said trough being positioned such that the underside of the roll is bathed by water within the trough when the trough is filled with water to a predetermined level; and d) said roll, drive device and trough being attached together as a removable, modular unit.

* * * * *

UNITED STATES PATENT AND TRADEMARK OFFICE

CERTIFICATE OF CORRECTION

PATENT NO. : 5,535,599

DATED : July 16, 1996

INVENTOR(S) : Olan R. Smith, et al.

It is certified that error appears in the above-indentified patent and that said Letters Patent is hereby corrected as shown below:

| | |
|---|---|
| Col. 2, line 60, | delete "s" in "as". |
| Col. 4, line 13, | add --to-- after "thereof". |
| Col. 6, line 14, | delete "p1" after "comprising:". |
| Col. 6, line 14, | after "comprising:" insert a line-break and indent the next line. |

Signed and Sealed this

Fifth Day of November, 1996

Bruce Lehman

*Attest:*

BRUCE LEHMAN

*Attesting Officer*

*Commissioner of Patents and Trademarks*